US011453925B2

(12) United States Patent
Miki et al.

(10) Patent No.: US 11,453,925 B2
(45) Date of Patent: Sep. 27, 2022

(54) SEAMLESS STEEL PIPE AND METHOD FOR PRODUCING SAME

(71) Applicant: Nippon Steel & Sumitomo Metal Corporation, Tokyo (JP)

(72) Inventors: Takeshi Miki, Tokyo (JP); Yuji Arai, Tokyo (JP); Yusuke Mihara, Tokyo (JP); Yohsuke Uchida, Tokyo (JP); Masahiro Yamazaki, Tokyo (JP); Masayuki Yamamoto, Tokyo (JP)

(73) Assignee: Nippon Steel Corporation, Tokyo (JP)

( * ) Notice: Subject to any disclaimer, the term of this patent is extended or adjusted under 35 U.S.C. 154(b) by 172 days.

(21) Appl. No.: 16/321,854

(22) PCT Filed: Jul. 28, 2017

(86) PCT No.: PCT/JP2017/027529
§ 371 (c)(1),
(2) Date: Jan. 30, 2019

(87) PCT Pub. No.: WO2018/025778
PCT Pub. Date: Feb. 8, 2018

(65) Prior Publication Data

US 2019/0177813 A1 Jun. 13, 2019

(30) Foreign Application Priority Data

Aug. 1, 2016 (JP) ..... JP2016-150947

(51) Int. Cl.
*C21D 9/08* (2006.01)
*C22C 38/54* (2006.01)
(Continued)

(52) U.S. Cl.
CPC ..... *C21D 9/085* (2013.01); *C21D 1/25* (2013.01); *C21D 6/004* (2013.01); *C21D 6/005* (2013.01);
(Continued)

(58) Field of Classification Search
CPC ..... C21D 9/085; C21D 1/25; C21D 6/004; C22C 38/001
See application file for complete search history.

(56) References Cited

U.S. PATENT DOCUMENTS

| | | | | |
|---|---|---|---|---|
| 5,938,865 | A | 8/1999 | Kondo et al. | |
| 2012/0205016 | A1 | 8/2012 | Arai et al. | |
| 2013/0264123 | A1* | 10/2013 | Altschuler | C22C 38/06 175/325.2 |

FOREIGN PATENT DOCUMENTS

| | | | |
|---|---|---|---|
| CN | 102741438 | A | 10/2012 |
| JP | H08-311551 | A | 11/1996 |

(Continued)

*Primary Examiner* — Robert S Jones, Jr.
*Assistant Examiner* — Jiangtian Xu
(74) *Attorney, Agent, or Firm* — Banner & Witcoff, Ltd.

(57) ABSTRACT

A seamless steel pipe is provided that has a chemical composition which consists of, by mass %, C: 0.10 to 0.20%, Si: 0.05 to 1.0%, Mn: 0.05 to 1.2%, P≤0.025%, S≤0.005%, Cu≤0.20%, N≤0.007%, Ni: 0.20 to 0.50%, Cr: 0.30% or more and less than 0.50%, Mo: 0.30 to 0.50%, Nb: 0.01 to 0.05%, Al: 0.001 to 0.10%, B: 0.0005 to 0.0020%, Ti: 0.003 to 0.050%, V: 0.01 to 0.20%, a total of any one or more elements among Ca, Mg and REM: 0 to 0.025%, and the balance: Fe and impurities, and for which Pcm (=C+(Si/30)+(Mn/20)+(Cu/20)+(Ni/60)+(Cr/20)+(Mo/15)+(V/10)+5B)≤0.30. The steel micro-structure includes, in area %, tempered martensite ≥90%. The tensile strength is 980 MPa or more, and a Charpy impact value at −40° C. using a 2 mm V-notch test specimen is 75 J/cm$^2$ or more.

4 Claims, 2 Drawing Sheets

Test No. 1

(51) Int. Cl.

| | |
|---|---|
| ***C21D 1/25*** | (2006.01) |
| ***C21D 6/00*** | (2006.01) |
| ***C21D 8/10*** | (2006.01) |
| ***C22C 38/00*** | (2006.01) |
| ***C22C 38/02*** | (2006.01) |
| ***C22C 38/04*** | (2006.01) |
| ***C22C 38/06*** | (2006.01) |
| ***C22C 38/42*** | (2006.01) |
| ***C22C 38/44*** | (2006.01) |
| ***C22C 38/46*** | (2006.01) |
| ***C22C 38/48*** | (2006.01) |
| ***C22C 38/50*** | (2006.01) |

(52) U.S. Cl.

CPC ..... *C21D 6/008* (2013.01); *C21D 8/105* (2013.01); *C21D 9/08* (2013.01); *C22C 38/001* (2013.01); *C22C 38/002* (2013.01); *C22C 38/02* (2013.01); *C22C 38/04* (2013.01); *C22C 38/06* (2013.01); *C22C 38/42* (2013.01); *C22C 38/44* (2013.01); *C22C 38/46* (2013.01); *C22C 38/48* (2013.01); *C22C 38/50* (2013.01); *C22C 38/54* (2013.01); *C21D 2211/008* (2013.01)

(56) References Cited

FOREIGN PATENT DOCUMENTS

| | | | |
|---|---|---|---|
| JP | 2001-240913 | A | 9/2001 |
| JP | 2006-283117 | A | 10/2006 |
| JP | 2012-036501 | A | 2/2012 |
| JP | 2012-107333 | A | 6/2012 |
| JP | 2012-193404 | A | 10/2012 |
| JP | 2013-139610 | A | 7/2013 |
| JP | 2016-094649 | A | 5/2016 |
| WO | 2008050628 | A1 | 5/2008 |
| WO | 2010061882 | A1 | 6/2010 |

* cited by examiner

Test No. 1

Test No. 3

Test No. 31

SEAMLESS STEEL PIPE AND METHOD FOR PRODUCING SAME

RELATED APPLICATION DATA

This application is a National Stage Application under 35 U.S.C. 371 of co-pending PCT application number PCT/JP2017/027529 designating the United States and filed Jul. 28, 2017; which claims the benefit of JP application number 2016-150947 and filed Aug. 1, 2016 each of which are hereby incorporated by reference in their entireties.

TECHNICAL FIELD

The present invention relates to a seamless steel pipe and a method for producing the seamless steel pipe.

BACKGROUND ART

Among machine structural members, many cylindrical members have conventionally been produced by subjecting a steel bar to forging or elongation rolling, or furthermore to cutting, to thereby form the steel bar into a desired shape, and thereafter performing a heat treatment thereon to provide mechanical properties that are necessary for the machine structural member.

However, in recent years, accompanying the trend towards increasing the size and yield stress of machine structures, attempts have been made to reduce the weight of machine structures by replacing a cylindrical machine structural members with a hollow-shell seamless steel pipe. In particular, steel pipes to be used for crane booms have been required to have enhanced strength and also enhanced toughness in view of increases in the sizes of cranes for use in operations for high-rise buildings and also because of the necessity for the cranes to operate in cold districts and the like. Specifically, recently, as an application of steel pipes for use in crane booms, seamless steel pipes that have a tensile strength of 980 MPa or more and also have excellent toughness at a low temperature of −40° C. are being requested.

Various kinds of technology have been disclosed in relation to seamless steel pipes having high strength and high toughness, and also in relation to methods for producing such seamless steel pipes.

For example, Patent Document 1 discloses a method that enables production of a high strength seamless steel pipe which is excellent in toughness by an on-line thermo-mechanical treatment without adding an expensive alloy steel.

Patent Document 2 discloses a seamless steel pipe having a tensile strength of 950 MPa or more, a yield strength of 850 MPa or more and for which a Charpy absorbed energy at −40° C. is 60 J or more, as well as a method for producing the seamless steel pipe.

Patent Document 3 discloses a seamless steel pipe having a tensile strength of 950 MPa or more, a yield strength of 850 MPa or more, and for which a Charpy absorbed energy at −40° C. is 60 J or more and which has a wall thickness of more than 30 mm, as well as a method for producing the seamless steel pipe.

LIST OF PRIOR ART DOCUMENTS

Patent Documents

Patent Document 1: JP2001-240913A
Patent Document 2: WO 2010/061882
Patent Document 3: JP2012-193404A

SUMMARY OF INVENTION

Technical Problem

The high strength seamless steel pipe disclosed in Patent Document 1 has a maximum tensile strength of 899 MPa, and it cannot be said that the strength is sufficient for use in a crane boom.

On the other hand, the seamless steel pipe disclosed in Patent Document 2 has high strength, namely, a tensile strength of 950 MPa or more and a yield strength being 850 MPa or more, and is also excellent in toughness at a low temperature, and the level of the characteristics after welding are also satisfactory. Further, with respect to the seamless steel pipe disclosed in Patent Document 3 also, in a case where the wall thickness thereof is a thick wall thickness of more than 30 mm, the seamless steel pipe has high strength, namely, a tensile strength of 950 MPa or more and a yield strength of 850 MPa or more, and is also excellent in toughness at a low temperature.

In addition to high strength and high toughness, a steel pipe that is to be used for a crane boom is also required to have high weldability. Pcm (weld crack sensitivity composition (%)) that is represented by Formula [A] below is well known as a measure for evaluating weldability.

$$Pcm=C+(Si/30)+(Mn/20)+(Cu/20)+(Ni/60)+(Cr/20)+(Mo/15)+(V/10)+5B \quad [A]$$

Where, each symbol of an element in Formula [A] represents a content (mass %) of a corresponding element in the steel, with a value of a symbol being zero if the corresponding element is not contained.

In general, the larger that the value of Pcm is, the greater the likelihood is that cold cracks will occur in a weld zone. Therefore, in actual welding, Pcm is often used as an index for managing the preheating temperature.

In addition, recently, in order to avoid complex welding, there is a tendency to omit preheating or to perform preheating at as low a temperature as possible. Therefore, with respect to seamless steel pipe products for crane booms, there are cases in which Pcm is used not just as a simple measure of weldability, but in which it is also requested as a specification that the value of Pcm be equal to or less than a predetermined value (specifically, for example, Pcm≤0.30). In such a case, with respect to a product for which Pcm>0.30, even if there will be absolutely no problem in practical terms if the weldability of the product is actually evaluated, the product in question will be rejected on the basis of the Pcm value before proceeding to such actual evaluation.

The seamless steel pipe disclosed in Patent Document 2 contains high amounts of Cr and Mo. Therefore, the occurrence of a situation in which the seamless steel pipe disclosed in Patent Document 2 cannot satisfy a strict requirement that the value of Pcm be not more than 0.30 can be supposed.

Further, since the seamless steel pipe disclosed in Patent Document 3 also contains high amounts of Cr and Mo, it is also possible to suppose the occurrence of a situation in which it is not possible for the seamless steel pipe disclosed in Patent Document 3 to satisfy a strict requirement that the value of Pcm be not more than 0.30. In addition, the method for producing the seamless steel pipe is a method in which, after subjecting a low alloy steel to pipe-making which is performed as a hot processing, quenching and tempering are performed twice or more. Therefore, in this respect the production method is disadvantageous in terms of productivity, and it can be supposed that the production method will lead to an increase in the energy cost.

An objective of the present invention is to provide a seamless steel pipe having a tensile strength of 980 MPa or more and for which an impact value at −40° C. using a 2 mm V-notch Charpy specimen (hereunder, referred to simply as "Charpy impact value at −40° C.") is 75 J/cm$^2$ or more and, furthermore, Pcm is 0.30 or less, as well as a method for producing the seamless steel pipe.

Solution to Problem

The present invention has been made to solve the problems described above, and the gist of the present invention is a seamless steel pipe and a method for producing the seamless steel pipe which are described hereunder.

(1) A seamless steel pipe having a chemical composition consisting of, by mass %, C: 0.10 to 0.20%,
Si: 0.05 to 1.0%,
Mn: 0.05 to 1.2%,
P: 0.025% or less,
S: 0.005% or less,
Cu: 0.20% or less,
N: 0.007% or less,
Ni: 0.20 to 0.50%,
Cr: 0.30% or more and less than 0.50%,
Mo: 0.30 to 0.50%,
Nb: 0.01 to 0.05%,
Al: 0.001 to 0.10%,
B: 0.0005 to 0.0020%,
Ti: 0.003 to 0.050%,
V: 0.01 to 0.20%, a total of any one or more elements among Ca, Mg and REM: 0 to 0.025%, and the balance: Fe and impurities;

wherein:

a value of Pcm that is represented by Formula [A] below is 0.30 or less, a steel micro-structure includes, in area %, tempered martensite: 90% or more, a tensile strength is 980 MPa or more, and a Charpy impact value at −40° C. using a 2 mm V-notch test specimen is 75 J/cm$^2$ or more.

$$Pcm=C+(Si/30)+(Mn/20)+(Cu/20)+(Ni/60)+(Cr/20)+(Mo/15)+(V/10)+5B \quad [A]$$

where, each symbol of an element in Formula [A] represents a content (mass %) of a corresponding element in the steel, with a value of a symbol being zero if the corresponding element is not contained.

(2) A method for producing the seamless steel pipe described in (1) above, the method including performing processes [i] to [iv] hereunder in sequence using a cast piece having a chemical composition described in (1) above:

[i]: a hot rolling process of producing a material pipe by heating the cast piece to 1200 to 1300° C., and thereafter subjecting the cast piece to working with a reduction of area in a range of 40 to 99%;

[ii]: a cooling process of cooling the material pipe to a temperature that is less than an $Ac_1$ point;

[iii]: a quenching process of heating the cooled material pipe to a temperature in a range from an $Ac_3$ point to 950° C., and thereafter rapidly cooling the material pipe; and

[iv]: a tempering process of heating the quenched material pipe to a temperature in a range from 500 to 600° C., and thereafter cooling to room temperature.

Advantageous Effects of Invention

According to the present invention it is possible to obtain a seamless steel pipe which has high strength, namely, a tensile strength of 980 MPa or more, and which is excellent in low-temperature toughness, and which is also excellent in weldability, with a Pcm value thereof being a small value that is not more than 0.30.

DESCRIPTION OF EMBODIMENTS

Figure 1:
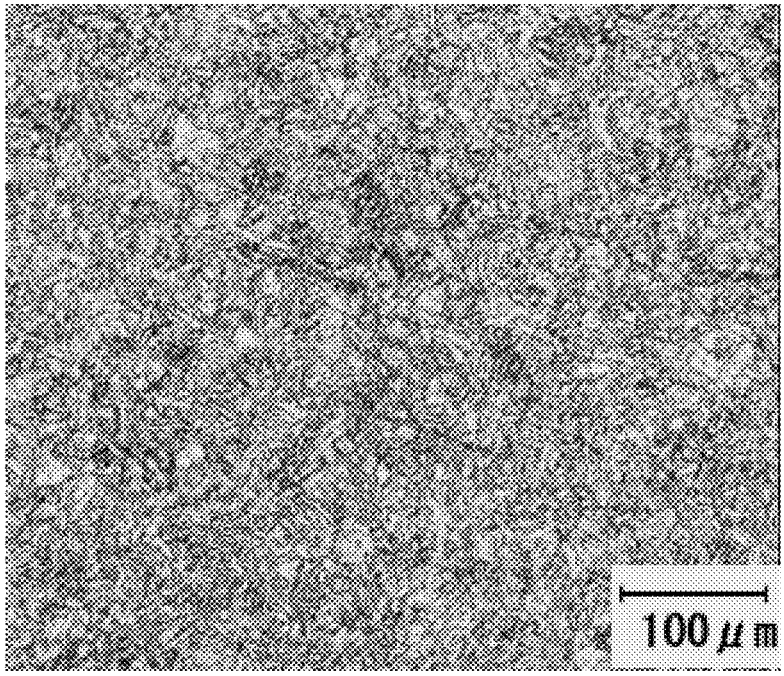
FIG. 1 is a micro-structure photograph of Test No. 1 in which an area fraction of tempered martensite was 90% or more and less than 95%.

The present inventors conducted concentrated studies regarding techniques for obtaining a seamless steel pipe that is based on a low alloy steel whose chemical composition is inexpensive, and which, by performing quenching and tempering only once after being subjected to pipe-making that is performed as a hot processing, can secure a predetermined strength and Charpy impact value, and for which a Pcm is 0.30 or less. As a result, the present inventors obtained the following important findings.

(a) In order to control Pcm to be a low value of 0.30 or less from the viewpoint of weldability, it suffices to make the content of alloying elements included in the aforementioned Formula [A] low. However, if the amount of the alloying elements is simply reduced, it will lead to a reduction in hardenability and an adequate quenching structure will not be obtained. Therefore, even if it is possible to secure satisfactory weldability, a predetermined strength and toughness cannot both be obtained in a compatible manner.

(b) If the content of B is 0.0020% or less by mass %, by limiting the upper limit of the content of each of Cr and Mo to 0.50% by mass % in order to decrease Pcm, coarse boron carbides are not formed during tempering even in the case of a steel that contains these elements in combination, so that satisfactory low-temperature toughness can be secured. In other words, there may be a component system of a low alloy steel that, by containing an appropriate amount of B, can enhance hardenability at a comparatively low cost and obtain both strength and toughness in a compatible manner.

(c) On the other hand, in order to obtain both high strength and high toughness in a compatible manner by performing quenching and tempering only once, it suffices to make austenite grains fine during the quenching.

The present invention has been completed based on the above findings. The respective requirements of the present invention are described in detail hereunder.

(A) Chemical Composition

The reasons for limiting the chemical composition of the seamless steel pipe and cast piece according to the present invention are as follows. The symbol "%" with respect to the content of each element in the following description means "mass percent".

C: 0.10 to 0.20%

C is an indispensable element for increasing strength. If the C content is less than 0.10%, in some cases it is difficult to obtain a high strength that is a tensile strength of 980 MPa or more depending on the relation with other elements. On the other hand, if the C content is more than 0.20%, the weldability will noticeably decrease. Accordingly, the C content is set within a range of 0.10 to 0.20%. The C content is preferably not less than 0.12%, and is preferably not more than 0.18%.

Si: 0.05 to 1.0%

Si has a deoxidizing action, and also has actions that improve strength and hardenability. To obtain these effects, it is necessary to make the Si content 0.05% or more. However, if the Si content is more than 1.0%, the toughness and weldability will decrease. Accordingly, the Si content is set within a range of 0.05 to 1.0%. The Si content is preferably not less than 0.1%, and is preferably not more than 0.6%.

Mn: 0.05 to 1.2%

Mn has a deoxidizing action, and also has actions that improve strength and hardenability. To obtain these effects, it is necessary to contain 0.05% or more of Mn. However, if the Mn content is more than 1.2%, the toughness will decrease. Accordingly, the Mn content is set within a range of 0.05 to 1.2%. The Mn content is preferably not less than 0.30%, and is preferably not more than 1.10%.

P: 0.025% or less

If the P content is more than 0.025%, there will be a noticeable decrease in the toughness and it will be difficult to secure the predetermined Charpy impact value. Therefore, the content of P as an impurity is made not more than 0.025%. The P content is preferably 0.020% or less.

S: 0.005% or less

If the S content is more than 0.005%, there will be a noticeable decrease in the toughness and it will be difficult to secure the predetermined Charpy impact value. Therefore, the content of S as an impurity is made not more than 0.005%. The S content is preferably not more than 0.003%.

Cu: 0.20% or less

If the Cu content is more than 0.20%, it may cause a decrease in hot workability. Therefore, the content of Cu as an impurity is made not more than 0.20%. The Cu content is preferably not more than 0.05%.

N: 0.007% or less

If the N content is more than 0.007%, coarse nitrides will be formed and it will be difficult to secure dissolved B, and in particular, in a thick-walled seamless steel pipe, the advantageous effect of improving hardenability of B will be insufficient and an adequate quenching structure will not be obtained and a decrease in toughness will be noticeable, and hence it will be difficult to secure the predetermined Charpy impact value. Therefore, the content of N as an impurity is made not more than 0 007%. The N content is preferably not more than 0.006%.

Ni: 0.20 to 0.50%

Ni has actions that improve hardenability, strength and toughness. In order to obtain these effects, it is necessary for 0.20% or more of Ni to be contained. On the other hand, if more than 0.50% of Ni is contained, the alloy cost will increase. Accordingly, the Ni content is set within a range of 0.20 to 0.50%. The Ni content is preferably not less than 0.30%, and is preferably not more than 0.40%.

Cr: 0.30% or more and less than 0.50%

Cr has actions that improve hardenability and strength. In order to obtain these effects, it is necessary for 0.30% or more of Cr to be contained. On the other hand, in order to secure satisfactory hardenability, in the case of a low alloy steel containing 0.0005 to 0.0020% of B and also containing Cr and Mo in combination that is described later, if the Cr content is 0.50% or more, coarse boron carbides will be formed during tempering and may cause a decrease in toughness. Further, the Pcm (weld crack sensitivity composition) will increase and weld cracking is liable to occur. Accordingly, the Cr content is set within a range of 0.30% or more and less than 0.50%. The Cr content is preferably 0.40% or more. Further, the Cr content is preferably not more than 0.47%, and is preferably not more than 0.45%.

Mo: 0.30 to 0.50%

Mo has actions that improve hardenability and strength. In order to obtain these effects, it is necessary for 0.30% or more of Mo to be contained. On the other hand, in order to secure satisfactory hardenability, in the case of a low alloy steel containing 0.0005 to 0.0020% of B and also containing Mo and Cr in combination that is described later, if the Mo content is more than 0.50%, coarse boron carbides will be formed during tempering and may cause a decrease in toughness. Further, the Pcm (weld crack sensitivity composition) will increase and weld cracking is liable to occur. Accordingly, the Mo content is set within a range of 0.30% to 0.50%. The Mo content is preferably 0.40% or more, and preferably is 0.45% or less.

Nb: 0.01 to 0.05%

Nb combines with C or/and N to form fine precipitates and has an action that suppresses coarsening of austenite grains and increases the toughness. In order to stably obtain the aforementioned effect, it is necessary for 0.01% or more of Nb to be contained. However, if Nb is contained in an amount that is more than 0.05%, the amount of precipitates will increase and the Nb may instead decrease the toughness. Accordingly, the Nb content is set within a range of 0.01 to 0.05%. The Nb content is preferably 0.02% or more, and preferably is 0.04% or less.

Al: 0.001 to 0.10%

Al is an element that has a deoxidizing action. In order to ensure this effect, it is necessary for 0.001% or more of Al to be contained. On the other hand, if more than 0.10% of Al is contained, the aforementioned effect will be saturated, and in addition the occurrence of macro-streak-flaws will also increase. Accordingly, the Al content is set within a range of 0.001 to 0.10%. The Al content is preferably not less than 0.025%, and preferably is not more than 0.055%. Note that, in the present invention, the term "Al content" refers to the content of acid-soluble Al (so-called "sol. Al").

B: 0.0005 to 0.0020%

B is an extremely important element for providing an adequate quenching structure in a thick-walled seamless steel pipe in which Pcm is kept to a low value of 0.30 or less from the viewpoint of weldability, and it is necessary for the chemical composition thereof to contain 0.0005% or more of B. However, if the B content is more than 0.0020%, even if the upper limit of the respective contents of Cr and Mo is 0.50%, in a case where B is contained in combination with these elements, coarse boron carbides may sometimes be formed during tempering and cause a decrease in toughness. Accordingly, the B content is set within a range of 0.0005 to 0.0020%. The B content is preferably not less than 0.0008%, and preferably is not more than 0.0015%.

Ti: 0.003 to 0.050%

Ti precipitates as Ti carbides during tempering, and has an action that enhances the strength of the steel. Ti also has an action that fixes N and secures a sufficient amount of effective dissolved B for exerting an advantageous effect of improving hardenability of B. These effects are obtained when the Ti content is 0.003% or more. However, if the content of Ti is more than 0.050%, coarse Ti carbo-nitrides will form in a high-temperature region during solidification or the like, and furthermore, because the precipitated amount of Ti carbides during tempering will be excessive, the toughness will decrease. Accordingly, the Ti content is set within a range of 0.003 to 0.050%. The Ti content is preferably 0.005% or more, and is preferably 0.015% or less.

Further, as described in the foregoing, in order to fix N, it is preferable that the expression Ti/N≥48/14 is satisfied.

V: 0.01 to 0.20%

V precipitates as V carbides during tempering, and has an action that enhances the strength of the steel. This effect is obtained when the V content is 0.01% or more. However, if the V content is more than 0.20%, because the precipitated amount of V carbides during tempering will be excessive, the toughness will decrease. Further, the Pcm value will be high and weld cracking will be liable to occur. Accordingly, the V content is set within a range of 0.01 to 0.20%. The V content is preferably not less than 0.04%, and is preferably not more than 0.15%.

Total of any one or more elements among Ca, Mg and REM: 0 to 0.025%

Ca, Mg and REM each have an action that improves the form of inclusions by reacting with S to form sulfides, to thereby enhance the toughness. Therefore, any one or more elements among Ca, Mg and REM may be contained as required. In order to stably obtain the aforementioned effect, the content of these components is preferably not less than 0.0005% is total. On the other hand, if the total content of these components is more than 0.025%, the amount of inclusions will increase and the cleanliness of the steel will decrease, and therefore the toughness will instead decrease. Accordingly, the upper limit of the total content of these elements is set as 0.025%. The total content is preferably not more than 0.01%, and more preferably is not more than 0.005%.

In the present invention, the term "REM" refers to a total of 17 elements that are Sc, Y and the lanthanoids, and in a case where one type of REM element is contained, the term "content of REM" refers to the content of the relevant one type of REM element, and in a case where two or more types of REM element are contained, the term "content of REM" refers to the total content of the two or more types of REM element. Further, REM is generally supplied as a misch metal that is an alloy of a plurality of types of REM element. Therefore, REM elements may be contained by adding one or more types of individual elements, or for example, may be added in the form of a misch metal.

The seamless steel pipe and cast piece according to the present invention are composed of the respective elements described above and the balance that is Fe and impurities. Here, the term "impurities" refers to components which are mixed in from raw material such as ore or scrap or due to various factors in the production process during industrial production of a ferrous metal material, and which are allowed to be contained in an amount that does not adversely affect the present invention.

Pcm: 0.30 or less

In the seamless steel pipe and cast piece according to the present invention, Pcm that is represented by Formula (A) hereunder is 0.30 or less.

$$Pcm=C+(Si/30)+(Mn/20)+(Cu/20)+(Ni/60)+(Cr/20)+(Mo/15)+(V/10)+5B \quad [A]$$

where, each symbol of an element in Formula [A] represents a content (mass %) of a corresponding element in the steel, with a value of a symbol being zero if the corresponding element is not contained.

Note that, the respective elements on the right side of Pcm each have an effect that increases the strength of the steel pipe, and therefore if Pcm is very small there is a possibility that the required strength will not be obtained. It is considered that the practical lower limit of Pcm for stably obtaining a high strength that is a tensile strength of 980 MPa or more is about 0.22.

(B) Steel Micro-Structure

In order to compatibly obtain both high strength and high toughness, the seamless steel pipe according to the present invention has a steel micro-structure that is principally composed of tempered martensite. Specifically, the area fraction of tempered martensite is made 90% or more. Although the micro-structure of the balance is not particularly limited, the micro-structure may include one or more kinds selected from bainite, ferrite and pearlite.

In the present invention, the steel micro-structure is measured by the following method. First, a test specimen for observation is taken from the seamless steel pipe in a manner so that a cross-section perpendicular to the rolling direction becomes the observation surface. The observation surface is then polished, and thereafter nital etching is performed. Thereafter, the area fraction of tempered martensite is determined based on a micro-structure photograph that was photographed using an optical microscope having a magnification of ×500.

(C) Characteristics

The tensile strength (hereunder, referred to as "TS") of the seamless steel pipe according to the present invention is 980 MPa or more. When the TS is 980 MPa or more, because weight reductions can be stably implemented, the seamless steel pipe can be employed with sufficient stability for use in a crane boom that is capable of corresponding to increases in the sizes of cranes. A preferable lower limit of the TS of the seamless steel pipe is 1000 MPa. A preferable upper limit of the TS of the seamless steel pipe is 1100 MPa. Note that the yield stress (hereunder, referred to as "YS") of the seamless steel pipe according to the present invention is preferably 890 MPa or more, and more preferably is 900 MPa or more.

Further, a Charpy impact value at −40° C. of the seamless steel pipe according to the present invention is 75 J/cm$^2$ or more. If the Charpy impact value at −40° C. is 75 J/cm$^2$ or more, the seamless steel pipe can also be employed with sufficient stability for use in a crane boom which is to perform operations in cold districts. A preferable lower limit of the Charpy impact value at −40° C. of the seamless steel pipe is 125 J/cm$^2$, and the higher that the Charpy impact value at −40° C. is, the more preferable.

(D) Wall Thickness

No particular limit is set with respect to the wall thickness of the seamless steel pipe according to the present invention. However, if the wall thickness is less than 10 mm, there is a risk that it will not be possible to secure the required strength in the case of use as a machine structural member. On the other hand, if the wall thickness is more than 45 mm, bainite is liable to occur, and it will be difficult to obtain a micro-structure that is principally composed of tempered martensite. Accordingly, the wall thickness is preferably within a range of 10 to 45 mm. The wall thickness is preferably not less than 20 mm, and is preferably not more than 40 mm.

(E) Production Method

The seamless steel pipe according to the present invention can be produced by the following method.

A steel having the chemical composition described in the above section (A) is melted using the same method as the method employed for a common low alloy steel, and thereafter the molten steel is made into an ingot or cast piece by casting. Note that, the steel may be cast into a cast piece having a round billet shape for pipe-making by a so-called "round continuous casting" method.

As the next process, the cast ingot or cast piece is subjected to blooming or hot forging. This process is one that obtains a starting material to be used in the final hot rolling (for example, pipe-making by a piercing, rolling and elongation process performed as hot processing, or pipe-making using a hot extrusion press). Note that, depending on the aforementioned "round continuous casting" method, a cast piece that was formed into a round billet shape can be directly finished into a seamless steel pipe, and hence blooming or hot forging need not necessarily be performed.

The seamless steel pipe of the present invention is produced by performing the processes from (i) to (vi) described hereunder in sequence on the starting material or cast piece formed into a round billet shape (hereunder, referred to as "cast piece") to be used for the final hot rolling, which were produced by the aforementioned blooming or hot forging.

[i]: A Hot Rolling Process of Producing a Material Pipe by Heating a Cast Piece to 1200 to 1300° C., and Thereafter Subjecting the Cast Piece to Working with a Reduction of Area in a Range of 40 to 99%;

After heating the aforementioned cast piece to 1200 to 1300° C., the cast piece is subjected to working with a reduction of area in a range of 40 to 99% to produce a material pipe having a predetermined shape. If the heating temperature of the cast piece is less than 1200° C., the deformation resistance during the subsequent working with a reduction of area in a range of 40 to 99% will be large and the load applied to the pipe-making facility will increase, and working defects such as flaws or cracks may occur. On the other hand, if the heating temperature of the cast piece is higher than 1300° C., it may cause high-temperature intergranular cracking or a reduction in ductility. Therefore, in the hot rolling process, first, the heating temperature is set in the range of 1200 to 1300° C.

Even if the heating temperature of the cast piece is within the aforementioned range, if the reduction of area during hot rolling after heating is less than 40%, in some cases a fine quenching structure will not be obtained in a quenching process of [iii] even after undergoing a cooling process of [ii] that is described later, and the seamless steel pipe cannot be provided with the desired mechanical characteristics. On the other hand, in the case of a pipe-making process in which the reduction of area is more than 99%, in some cases it is necessary to expand the pipe-making facility or the like. Accordingly, the hot rolling process is configured so as to performing working with a reduction of area in a range of 40 to 99%.

The term "heating temperature" used in the present description of the process of [i] refers to the temperature at the surface of the cast piece. A holding time period in the aforementioned temperature region is preferably set within the range of 60 to 300 minutes, although it will depend on the size and shape of the cast piece. Further, the material pipe finishing temperature with respect to the hot rolling is preferably set within the range of 850 to 950° C. The aforementioned term "material pipe finishing temperature" refers to the temperature at the outer surface of the material pipe. In the process of [i], a preferable lower limit of the heating temperature is 1230° C., and a preferable upper limit is 1280° C. In addition, a preferable lower limit of the reduction of area is 50%, and a preferable upper limit is 90%.

[ii]: Cooling Process of Cooling the Material Pipe to a Temperature that is Less than the $Ac_1$ Point The material pipe that was finished into a predetermined shape is cooled to a temperature that is less than the $Ac_1$ point in order to obtain a fine quenching structure in the quenching process of [iii]. There is no particular limit with respect to the cooling rate at such time. Note that, the material pipe after hot rolling may be cooled once to room temperature, and thereafter reheated and subjected to the next process of [iii], or after hot rolling, the material pipe may be cooled to a suitable temperature that is less than the $Ac_1$ point, and thereafter heated directly from the temperature in question and subjected to the next process of [iii]. The term "cooling temperature" as used with respect to the present process of [ii] refers to the temperature at the outer surface of the material pipe.

[iii]: Quenching Process of Heating the Cooled Material Pipe to a Range of the $Ac_3$ Point to 950° C., and Thereafter Rapidly Cooling the Material Pipe The material pipe that was cooled in the process in the aforementioned process of [ii] is then subjected to quenching by being rapidly cooled after being heated to a temperature in the range of the $Ac_3$ point to 950° C. If the heating temperature is less than the $Ac_3$ point, because austenitization is not completed, in some cases the seamless steel pipe cannot be provided with the predetermined mechanical characteristics. On the other hand, if the heating temperature is more than 950° C., in some cases fine austenite grains are not obtained by performing quenching only once, and the seamless steel pipe cannot be provided with the predetermined mechanical characteristics. Accordingly, the heating temperature during quenching is set within the range of the $Ac_3$ point to 950° C.

The holding time period at the aforementioned heating temperature is preferably set in a range of 5 to 30 minutes, although the holding time period will also depend on the size of the material pipe. If approximately uniform heating is possible, the heat treatment may be a rapid heating treatment for a short time period using induction heating. The term "heating temperature" as used with respect to the present process of [iii] refers to the temperature at the outer surface of the material pipe. As long as an adequate quenching structure can be obtained, a suitable method such as water-cooling or oil-cooling may be used for the rapid cooling. In the process of [iii], a preferable lower limit of the heating temperature is 880° C., and a preferable upper limit is 920° C.

[iv]: A Tempering Process of Heating the Quenched Material Pipe to a Temperature in a Range of 500 to 600° C., and Thereafter Cooling the Material Pipe to Room Temperature In order to provide the material pipe that was quenched in the aforementioned process of [iii] with the predetermined mechanical characteristics as a seamless steel pipe, the material pipe is subjected to tempering by being heated to within a range of 500 to 600° C. and thereafter being cooled to room temperature. In the case of the chemical composition described in the foregoing section (A), if the heating temperature for tempering is less than 500° C., even if the predetermined strength (TS) can be secured, the low-temperature toughness will decrease and in some cases the Charpy impact value at −40° C. will be less than 75 J/cm$^2$. On the other hand, if the heating temperature for tempering is higher than 600° C., even if the predetermined low-temperature toughness (Charpy impact value at −40° C.) is obtained, the strength will decrease, and in some cases a high strength that is a TS of 980 MPa or more cannot be secured. Accordingly, the heating temperature during tempering is set within a range of 500 to 600° C.

The holding time period at the aforementioned heating temperature is preferably set within a range of 30 to 60 minutes, although the holding time period will also depend on the size of the material pipe. The term "heating temperature" as used with respect to the present process of [iv] refers to the temperature at the outer surface of the material pipe. There is no particular limit with respect to the cooling rate when performing tempering. Therefore, it suffices to conduct cooling in accordance with the facilities, such as by allowing cooling in atmospheric air, forced air-cooling, mist-cooling, oil-cooling or water-cooling. In the process of [iv], a preferable lower limit of the heating temperature is 525° C., and a preferable upper limit thereof is 575° C.

Hereunder, the present invention is described specifically by way of examples, although the present invention is not limited to the following examples.

EXAMPLES

Example 1

Steels A to K having the chemical compositions shown in Table 1 were melted using a 100 kg vacuum furnace. Each of the molten steels was poured into a mold to obtain an ingot. The respective ingots were then subjected to hot forging and worked into block shape having a thickness of 50 mm, a width of 120 mm and a length of 190 mm, and were cooled to room temperature. The respective blocks obtained in this manner were heated at 1250° C. for 30 minutes, and to simulate the production of a seamless steel pipe, as shown in Table 2, after performing hot rolling in which the width was restricted so that the reduction of area became 40% or 60% and the finishing temperature was in the range of 850 to 950° C., cooling to room temperature was performed to obtain plate material having a thickness of 20 mm or 30 mm.

Steels A to D in Table 1 are steels whose chemical compositions were within the range defined by the present invention. On the other hand, steels E to K are steels whose chemical compositions deviated from the conditions defined by the present invention. Note that, an $Ac_1$ point and $Ac_3$ point that were determined based on Formula (1) and Formula (2) below are also shown in Table 1.

$$Ac_1 \text{ point } (^\circ \text{ C.}) = 723 + 29.1 \times Si - 10.7 \times Mn - 16.9 \times Ni + 16.9 \times Cr \quad (1)$$

$$Ac_3 \text{ point } (^\circ \text{ C.}) = 910 - 203 \times C^{0.5} + 44.7 \times Si - 15.2 \times Ni + 31.5 \times Mo + 104 \times V - (30 \times Mn + 11 \times Cr + 20 \times Cu - 700 \times P - 400 \times Al - 400 \times Ti) \quad (2)$$

TABLE 1

| Steel | Chemical composition (in mass %, balance: Fe and impurities) | | | | | | | | | | |
|---|---|---|---|---|---|---|---|---|---|---|---|
| | C | Si | Mn | P | S | Cu | Ni | Cr | Mo | Nb | Al |
| A | 0.12 | 0.09 | 0.98 | 0.012 | 0.003 | 0.01 | 0.35 | 0.45 | 0.50 | 0.02 | 0.039 |
| B | 0.16 | 0.17 | 1.03 | 0.020 | 0.001 | 0.01 | 0.34 | 0.43 | 0.45 | 0.03 | 0.003 |
| C | 0.14 | 0.14 | 1.00 | 0.013 | 0.001 | 0.01 | 0.36 | 0.44 | 0.45 | 0.03 | 0.002 |
| D | 0.13 | 0.14 | 0.96 | 0.010 | 0.001 | 0.01 | 0.35 | 0.44 | 0.45 | 0.02 | 0.002 |
| E | 0.17 | 0.29 | 0.62 | 0.019 | 0.001 | 0.03 | 0.15 | 1.43 | 0.70 | 0.01 | 0.038 |
| F | 0.17 | 0.29 | 1.12 | 0.017 | 0.002 | 0.05 | 0.10 | 1.42 | 0.50 | — | 0.039 |
| G | 0.13 | 0.29 | 0.82 | 0.012 | 0.003 | 0.13 | 0.70 | 0.40 | 0.50 | — | 0.027 |
| H | 0.17 | 0.27 | 1.11 | 0.014 | 0.002 | 0.19 | 0.05 | 1.55 | 1.55 | 0.03 | 0.038 |
| I | 0.11 | 0.30 | 1.70 | 0.015 | 0.002 | 0.01 | — | 0.60 | 0.60 | 0.03 | 0.030 |
| J | 0.11 | 0.30 | 1.90 | 0.015 | 0.002 | 0.01 | — | 0.60 | 0.60 | 0.03 | 0.030 |
| K | 0.09 | 0.30 | 1.90 | 0.015 | 0.002 | 0.01 | — | 0.60 | 0.60 | 0.03 | 0.030 |

| Steel | Chemical composition (in mass %, balance: Fe and impurities) | | | | | | $Ac_1$ point | $Ac_3$ point |
|---|---|---|---|---|---|---|---|---|
| | Ti | V | B | N | Ca | Pcm | | |
| A | 0.007 | 0.05 | 0.0011 | 0.0038 | 0.0022 | 0.24 | 717 | 851 |
| B | 0.010 | 0.05 | 0.0019 | 0.0021 | 0.0023 | 0.29 | 718 | 834 |
| C | 0.005 | 0.05 | 0.0013 | 0.0022 | 0.0018 | 0.26 | 718 | 831 |
| D | 0.005 | 0.05 | 0.0010 | 0.0021 | 0.0012 | 0.25 | 718 | 833 |
| E | 0.008 | 0.02 | 0.0001 | 0.0059 | 0.0031 | 0.33 | 746 | 858 |
| F | 0.004 | 0.06 | 0.0002 | 0.0067 | — | 0.35 | 742 | 839 |
| G | 0.020 | 0.04 | 0.0001 | 0.0046 | 0.0016 | 0.25 | 718 | 855 |
| H | 0.011 | 0.04 | 0.0001 | 0.0063 | 0.0016 | 0.42 | 744 | 866 |
| I | 0.005 | 0.05 | 0.0010 | 0.0046 | 0.0020 | 0.29 | 724 | 847 |
| J | 0.005 | 0.05 | 0.0010 | 0.0044 | 0.0020 | 0.30 | 722 | 841 |
| K | 0.005 | 0.05 | 0.0010 | 0.0045 | 0.0020 | 0.28 | 722 | 847 |

The plate materials having a thickness of 20 mm or 30 mm obtained as described above were subjected to quenching and tempering under the conditions shown in Table 2, and thereafter the plate materials were investigated as described hereunder. Note that the quenching was all performed by immersion in an agitated water tank. The cooling when performing tempering was performed by allowing the plate materials to cool in atmospheric air.

First, a test specimen for observation was taken from each plate material (Test Nos. 1 to 26) in a manner so that a cross-section perpendicular to the rolling direction became the observation surface. The observation surface was polished, and thereafter nital etching was performed. Thereafter, the area fraction of tempered martensite was determined based on a micro-structure photograph that was photographed using an optical microscope having a magnification of ×500.

Figure 2:
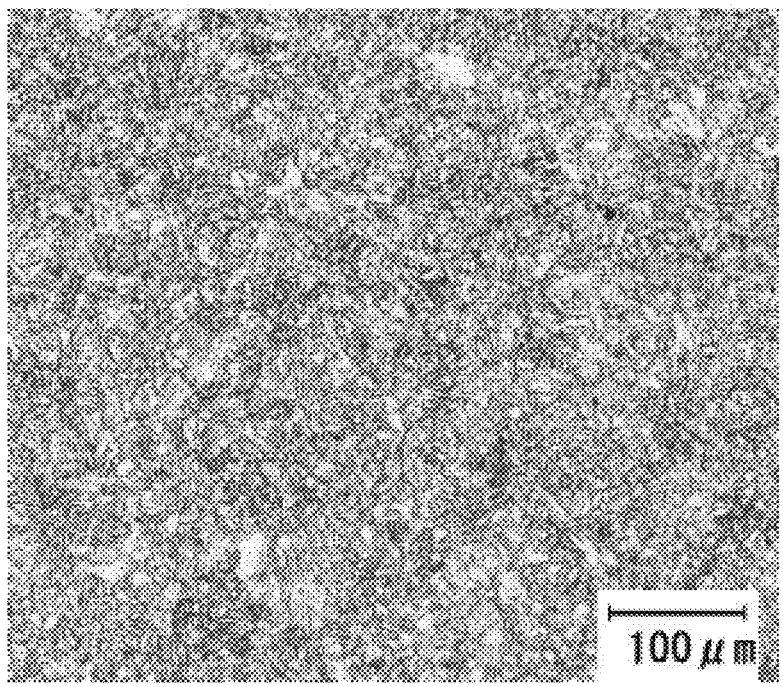
FIG. 2 is a micro-structure photograph of Test No. 3 in which an area fraction of tempered martensite was less than 90%.

FIGS. 1 and 2 show examples of the micro-structure photographs. FIG. 1 is a micro-structure photograph of Test No. 1 in which the area fraction of tempered martensite was 90% or more and less than 95%. FIG. 2 is a micro-structure photograph of Test No. 3 in which the area fraction of tempered martensite was less than 90%.

Next, a No. 10 tensile test coupon specified Annex D of JIS Z 2241-2011 was cut out in parallel with the rolling longitudinal direction from a central portion of the plate thickness of each plate material, and each of the obtained tensile test coupons were subjected to a tension test in atmospheric air at room temperature, and the YS and TS were determined. In addition, a 2-mm V-notch full size test specimen having a width of 10 mm was cut out in parallel with the rolling width direction from a central portion of the plate thickness of each plate material that had undergone quenching-tempering, and a Charpy impact test was conducted at −40° C. to evaluate absorbed energy and determine an impact value.

The results of the respective investigations described above are shown together in Table 2.

TABLE 2

| | | Hot rolling | | Quenching | | | Tempering | |
|---|---|---|---|---|---|---|---|---|
| Test No. | Steel | Finishing temperature (° C.) | Wall thickness (mm) | Heating temperature (° C.) | Holding time (min) | Cooling rate (° C./s) | Heating temperature (° C.) | Holding time (min) |
| 1 | A | 1250 | 20 | 920 | 15 | 18 | 600 | 30 |
| 2 | A | 1250 | 20 | 920 | 15 | 18 | 650 | 30 |
| 3 | A | 1250 | 30 | 920 | 15 | 5 | 600 | 30 |
| 4 | B | 1250 | 20 | 920 | 15 | 18 | 550 | 30 |
| 5 | B | 1250 | 20 | 920 | 15 | 18 | 600 | 30 |
| 6 | B | 1250 | 20 | 920 | 15 | 18 | 650 | 30 |
| 7 | C | 1250 | 20 | 920 | 15 | 18 | 500 | 30 |
| 8 | C | 1250 | 20 | 920 | 15 | 18 | 550 | 30 |
| 9 | C | 1250 | 20 | 920 | 15 | 18 | 600 | 30 |
| 10 | C | 1250 | 20 | 920 | 15 | 18 | 650 | 30 |
| 11 | C | 1250 | 20 | 920 | 15 | 18 | 600 | 60 |
| 12 | C | 1250 | 20 | 920 | 15 | 18 | 600 | 100 |
| 13 | C | 1250 | 20 | 920 | 15 | 18 | 600 | 150 |
| 14 | D | 1250 | 20 | 920 | 15 | 18 | 500 | 30 |
| 15 | D | 1250 | 20 | 920 | 15 | 18 | 550 | 30 |
| 16 | D | 1250 | 20 | 920 | 15 | 18 | 600 | 30 |
| 17 | D | 1250 | 20 | 920 | 15 | 18 | 650 | 30 |
| 18 | E | 1250 | 20 | 920 | 15 | 18 | 600 | 30 |
| 19 | F | 1250 | 20 | 920 | 15 | 18 | 600 | 30 |
| 20 | G | 1250 | 20 | 920 | 15 | 18 | 500 | 30 |
| 21 | H | 1250 | 20 | 920 | 15 | 18 | 680 | 30 |
| 22 | I | 1250 | 30 | 920 | 30 | 5 | 550 | 60 |
| 23 | J | 1250 | 30 | 920 | 30 | 5 | 550 | 60 |
| 24 | J | 1250 | 30 | 920 | 30 | 5 | 600 | 60 |
| 25 | K | 1250 | 30 | 920 | 30 | 5 | 550 | 60 |
| 26 | K | 1250 | 30 | 920 | 30 | 5 | 600 | 60 |

| | Tempered | Result of tension test at room temperature | | | |
|---|---|---|---|---|---|
| Test No. | martensite area ratio#1 (%) | Yield strength [YS] (MPa) | Tensile strength [TS] (MPa) | Charpy impact value at −40° C. (J/cm$^2$) | |
| 1 | ≥90 | 945 | 986 | 100 | Inventive ex. |
| 2 | ≥90 | 914 | 942 | 136 | Comparative |
| 3 | <90 | 884 | 941 | 195 | example |
| 4 | ≥90 | 1005 | 1052 | 194 | Inventive |
| 5 | ≥90 | 973 | 1026 | 90 | example |
| 6 | ≥90 | 932 | 958 | 98 | Comp. ex. |
| 7 | ≥90 | 1000 | 1058 | 198 | Inventive |
| 8 | ≥90 | 982 | 1037 | 188 | example |
| 9 | ≥90 | 951 | 993 | 209 | |
| 10 | ≥90 | 925 | 952 | 269 | Comp. ex. |
| 11 | ≥90 | 944 | 983 | 218 | Inventive ex. |
| 12 | ≥90 | 939 | 974 | 235 | Comparative |
| 13 | ≥90 | 937 | 970 | 220 | example |
| 14 | ≥90 | 1005 | 1042 | 303 | Inventive |
| 15 | ≥90 | 984 | 1008 | 245 | example |
| 16 | ≥90 | 954 | 983 | 225 | |
| 17 | ≥90 | 927 | 945 | 229 | Comparative |
| 18 | ≥90 | 980 | 1060 | 175 | example |
| 19 | ≥90 | 970 | 1000 | 163 | |
| 20 | ≥90 | 928 | 989 | 63 | |
| 21 | ≥90 | 955 | 1060 | 44 | |
| 22 | ≥90 | 832 | 935 | 81 | |
| 23 | ≥90 | 946 | 1031 | 60 | |

TABLE 2-continued

| | | | | |
|---|---|---|---|---|
| 24 | ≥90 | 907 | 985 | 64 |
| 25 | ≥90 | 887 | 977 | 65 |
| 26 | ≥90 | 855 | 927 | 99 |

[#1] "≥90" indicates 90% or more and less than 95%, and "<90" indicates less than 90%.

As shown in Table 2, it is clear that Test Nos. 1, 4, 5, 7 to 9, 11, and 14 to 16 that are inventive examples which were produced by the method defined by the present invention using steels A to D having a chemical composition defined by the present invention had a high strength, namely, a TS of 980 MPa or more and a YS of 890 MPa or more, and were also excellent in low-temperature toughness, and furthermore, because Pcm was a low value of 0.30 or less, it can be easily assumed that the test specimens of these test numbers were also excellent in weldability.

In contrast, in the case of the test numbers that are comparative examples, at least a predetermined mechanical characteristic was not obtained or the test specimens of these test numbers were inferior with regard to weldability.

That is, as shown in Test Nos. 2, 3, 6, 10, 12, 13 and 17, even when steels A to D having a chemical composition defined by the present invention were used, in a case where the production conditions deviated from the conditions defined by the present invention, TS was low and did not reach 980 MPa.

On the other hand, in a case where the chemical composition of a steel that was used deviated from the conditions defined by the present invention, as shown in Test Nos. 18 to 26, irrespective of whether the production conditions satisfied or did not satisfy the conditions defined by the present invention, at least a predetermined mechanical characteristic was not obtained or the test specimens of these test numbers were inferior with regard to weldability since the Pcm value was high.

Example 2

A steel L having a chemical composition shown in Table 3 was melted, and was cast by a converter-continuous casting process to form a rectangular billet. The rectangular billet was further formed by hot forging into a round billet having an outside diameter of 191 mm, a round billet having an outside diameter of 225 mm, and a round billet having an outside diameter of 310 mm, and these billets were cooled to room temperature.

Each of the aforementioned round billets was heated to 1240° C., and seamless steel pipe of various wall thicknesses shown in Table 4 were produced by the Mannesmann-mandrel process so that the finishing temperature was within the range of 850 to 950° C., and these seamless steel pipes were cooled to room temperature. The respective seamless steel pipes obtained in this manner were subjected to quenching and tempering under the conditions shown in Table 4 to produce product steel pipes. Note that the quenching was all performed by water quenching. The cooling when performing tempering was all performed by allowing cooling in atmospheric air.

Figure 3:
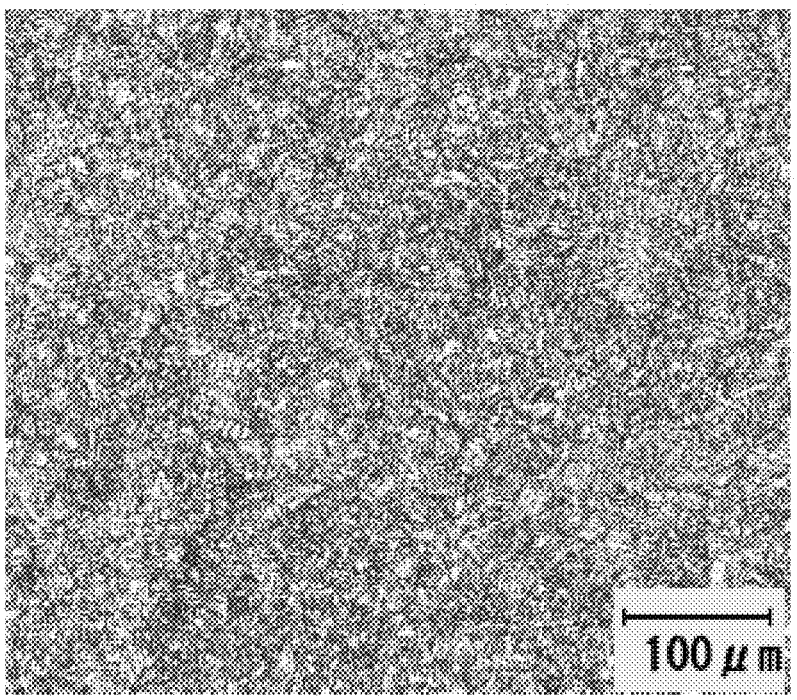
FIG. 3 is a micro-structure photograph of Test No. 31 in which an area fraction of tempered martensite was 95% or more.

Thereafter, for each product steel pipe (Test Nos. 27 to 38), the area fraction of tempered martensite was determined in the same way as in Example 1. FIG. 3 is a micro-structure photograph of Test No. 31 in which the area fraction of tempered martensite was 95% or more.

Next, for each of the product steel pipes, a No. 12 test coupon specified in Annex E of JIS Z 2241-2011 was cut out from one end position or both end positions in the longitudinal direction (the front end side in the rolling direction is referred to as "T end", and the rear end side is referred to as "B end"), and a tension test was conducted in atmospheric air at room temperature, and the YS and TS were determined. In addition, for each of the aforementioned product steel pipes, three test specimens were obtained by cutting out, in parallel with the rolling longitudinal direction, 2-mm V-notch full size test specimens having a width of 10 mm (in a case where the product wall thickness was 20 mm or 38 mm) or 2-mm V-notch test specimens having a width of 3.3 mm (in a case where the product wall thickness was 5.74 mm) from one end position or both end positions in the longitudinal direction, and each set of three test specimens was subjected to a Charpy impact test at −40° C. to determine the average absorbed energy of the three test specimens, and the determined average absorbed energy was used to determine the impact value.

The results of each of the aforementioned investigations are shown together in Table 4.

TABLE 3

| | Chemical composition (in mass %, balance: Fe and impurities) | | | | | | | | | | |
|---|---|---|---|---|---|---|---|---|---|---|---|
| Steel | C | Si | Mn | P | S | Cu | Ni | Cr | Mo | Nb | Al |
| L | 0.14 | 0.29 | 0.98 | 0.010 | 0.002 | 0.02 | 0.37 | 0.43 | 0.46 | 0.03 | 0.040 |

| | Chemical composition (in mass %, balance: Fe and impurities) | | | | | | $Ac_1$ | $Ac_3$ |
|---|---|---|---|---|---|---|---|---|
| Steel | Ti | V | B | N | Ca | Pcm | point | point |
| L | 0.009 | 0.05 | 0.0016 | 0.0036 | 0.0022 | 0.27 | 722 | 853 |

TABLE 4

| Test No. | Steel | Hot rolling: Outside diameter of round billet (mm) | Hot rolling: Heating temperature (° C.) | Hot rolling: Final diameter (mm) | Hot rolling: Final wall thickness (mm) | Hot rolling: Reduction of area (%) | Quenching: Heating temperature (° C.) | Quenching: Holding time (min) | Quenching: Cooling rate (° C./s) | Tempering: Heating temperature (° C.) |
|---|---|---|---|---|---|---|---|---|---|---|
| 27 | L | 225 | 1240 | 191 | 20 | 73 | 920 | 5 | 46 | 500 |
| 28 | | 225 | 1240 | 191 | 20 | 73 | 920 | 5 | 46 | 525 |
| 29 | | 225 | 1240 | 191 | 20 | 73 | 920 | 5 | 46 | 550 |
| 30 | | 225 | 1240 | 191 | 20 | 73 | 920 | 5 | 46 | 575 |
| 31 | | 225 | 1240 | 191 | 20 | 73 | 920 | 5 | 46 | 600 |
| 32 | | 225 | 1240 | 191 | 20 | 73 | 920 | 5 | 46 | 550 |
| 33 | | 225 | 1240 | 191 | 20 | 73 | 920 | 5 | 46 | 550 |
| 34 | | 225 | 1240 | 191 | 20 | 73 | 920 | 5 | 46 | 550 |
| 35 | | 225 | 1240 | 191 | 20 | 73 | 920 | 5 | 46 | 550 |
| 36 | | 191 | 1240 | 102 | 6 | 94 | 920 | 5 | 128 | 520 |
| 37 | | 191 | 1240 | 102 | 6 | 94 | 920 | 5 | 128 | 520 |
| 38 | | 310 | 1240 | 242 | 38 | 68 | 920 | 5 | 20 | 550 |

| Test No. | Tempering Holding time (min) | Tempered martensite area ratio#1 (%) | Test position | Result of tension test at room temperature: Yield strength [YS] (MPa) | Result of tension test at room temperature: Tensile strength [TS] (MPa) | Charpy impact value at −40° C. (J/cm$^2$) |
|---|---|---|---|---|---|---|
| 27 | 30 | ≥95 | T | 928 | 1054 | 200 |
| 28 | 30 | ≥95 | T | 934 | 1039 | 200 |
| 29 | 30 | ≥95 | T | 940 | 1036 | 196 |
| 30 | 30 | ≥95 | T | 923 | 1019 | 209 |
| 31 | 30 | ≥95 | T | 914 | 994 | 214 |
| 32 | 30 | ≥95 | T | 991 | 1044 | 163 |
| 33 | 30 | ≥95 | B | 963 | 1029 | 195 |
| 34 | 30 | ≥95 | T | 965 | 1036 | 168 |
| 35 | 30 | ≥95 | B | 986 | 1037 | 130 |
| 36 | 30 | ≥95 | T | 978 | 1019 | 136 |
| 37 | 30 | ≥95 | B | 999 | 1041 | 144 |
| 38 | 30 | ≥90 | T | 910 | 995 | 175 |

#2 "≥90" indicates 90% or more and less than 95%, and "≥95" indicates 95% or more.

It is clear from Table 4 that, with respect to the steel pipes of Test Nos. 27 to 38 that are inventive examples produced by the method defined by the present invention using the steel L having a chemical composition defined by the present invention, for all the steel pipes having different dimensions, the steel pipes had a high strength, namely, a TS of 980 MPa or more and a YS of 890 MPa or more, and were also excellent in low-temperature toughness, and furthermore, because Pcm was a low value of 0.30 or less, it can be easily assumed that the steel pipes were also excellent in weldability.

INDUSTRIAL APPLICABILITY

The seamless steel pipe of the present invention has a high strength, namely, a tensile strength of 980 MPa or more, and is excellent in low-temperature toughness, and furthermore a Pcm value thereof is a low value of 0.30 or less. Therefore, the seamless steel pipe of the present invention is suitable for use as a machine structural member, and especially for use for a crane boom. Further, the aforementioned seamless steel pipe can be obtained at a low cost by employing the production method of the present invention.

The invention claimed is:

1. A hot-rolled seamless steel pipe having a chemical composition consisting of, by mass %, C: 0.10 to 0.17%,
Si: 0.05 to 1.0%,
Mn: 0.05 to 1.2%,
P: 0.025% or less,
S: 0.005% or less,
Cu: 0.20% or less,
N: 0.007% or less,
Ni: 0.20 to 0.50%,
Cr: 0.30% or more and less than 0.50%,
Mo: 0.30 to 0.50%,
Nb: 0.01 to 0.05%,
Al: 0.001 to 0.10%,
B: 0.0005 to 0.0020%,
Ti: 0.003 to 0.050%,
V: 0.01 to 0.20%,
a total of any one or more elements among Ca, Mg and REM: 0 to 0.025%, and the balance: Fe and impurities;

wherein:

a value of Pcm that is represented by Formula [A] below is 0.30 or less,
a steel micro-structure comprises, in area %, tempered martensite: 90% or more,
a tensile strength is 980 MPa or more,
a Charpy impact value at −40° C. using a 2 mm V-notch test specimen is 75 J/cm$^2$ or more, $$Pcm=C+(Si/30)+(Mn/20)+(Cu/20)+(Ni/60)+(Cr/20)+(Mo/15)+(V/10)+5B \quad [A]$$

where, each symbol of an element in Formula [A] represents a content (mass %) of a corresponding element in the steel, with a value of a symbol being zero if the corresponding element is not contained, and wherein the hot-rolled seamless steel pipe is produced by hot rolling the hot-rolled seamless steel pipe, cooling the hot-rolled seamless steel pipe, subjecting the hot-rolled seamless steel pipe to a quenching process, and subjecting the hot-rolled seamless steel pipe to a tempering process.

2. A method for producing a hot-rolled seamless steel pipe having a chemical composition consisting of, by mass %, C: 0.10 to 0.17%,
Si: 0.05 to 1.0%,
Mn: 0.05 to 1.2%,
P: 0.025% or less,
S: 0.005% or less,
Cu: 0.20% or less,
N: 0.007% or less,
Ni: 0.20 to 0.50%,
Cr: 0.30% or more and less than 0.50%,
Mo: 0.30 to 0.50%,
Nb: 0.01 to 0.05%,
Al: 0.001 to 0.10%,
B: 0.0005 to 0.0020%,
Ti: 0.003 to 0.050%,
V: 0.01 to 0.20%,
a total of any one or more elements among Ca, Mg and REM: 0 to 0.025%, and the balance: Fe and impurities;

wherein:

a value of Pcm that is represented by Formula [A] below is 0.30 or less,
a steel micro-structure comprises, in area %, tempered martensite: 90% or more,
a tensile strength is 980 MPa or more,
a Charpy impact value at −40° C. using a 2 mm V-notch test specimen is 75 J/cm$^2$ or more, $$Pcm=C+(Si/30)+(Mn/20)+(Cu/20)+(Ni/60)+(Cr/20)+(Mo/15)+(V/10)+5B \quad [A]$$

where, each symbol of an element in Formula [A] represents a content (mass %) of a corresponding element in the steel, with a value of a symbol being zero if the corresponding element is not contained, the method comprising performing processes [i] to [iv] hereunder in sequence using a cast piece having a chemical composition described in claim 1:

[i]: a hot rolling process of producing a material pipe by heating the cast piece to 1200 to 1300° C., and thereafter subjecting the cast piece to working with a reduction of area in a range of 40 to 99%;

[ii]: a cooling process of cooling the material pipe to a temperature that is less than an $Ac_1$ point;

[iii]: a quenching process of heating the cooled material pipe to a temperature in a range from an $Ac_3$ point to 950° C., and thereafter rapidly cooling the material pipe; and

[iv]: a tempering process of heating the quenched material pipe to a temperature in a range from 500 to 600° C., and thereafter cooling to room temperature.

3. The hot-rolled seamless steel pipe according to claim 1, wherein the tempering process includes heating the hot-rolled seamless steel pipe, after quenching, to a temperature in a range from 500 to 600° C., and thereafter cooling to room temperature.

4. The hot-rolled seamless steel pipe according to claim 1, wherein a wall thickness of the hot-rolled seamless steel pipe is 10 to 45 mm.

* * * * *